United States Patent [19]

Currie

[11] Patent Number: 4,607,799

[45] Date of Patent: Aug. 26, 1986

[54] MOBILE STONE CRUSHER

[76] Inventor: Bobby R. Currie, Rte. 1, Box 181, Kennard, Tex. 75847

[21] Appl. No.: 739,322

[22] Filed: May 30, 1985

[51] Int. Cl.[4] ..... B02C 13/282

[52] U.S. Cl. ..... 241/101.7; 241/189 R

[58] Field of Search ..... 241/275, 101.7, 189 R, 241/190, 195

[56] References Cited

U.S. PATENT DOCUMENTS 2,618,438 11/1952 Chrystal ..... 241/189 R X 3,170,643 2/1965 Hanse et al. ..... 241/189 R 3,850,375 11/1974 Ford ..... 241/101.7

*Primary Examiner*—Mark Rosenbaum

*Attorney, Agent, or Firm*—B. P. Fishburne, Jr.

[57] ABSTRACT

A stone crusher lifted and propelled by the arms of a track loader is disclosed. The stone crusher has a windrow tunnel formed through its bottom longitudinally and includes a hood having deflector plates above and in communication with the tunnel. An impact rotor within and across the tunnel propels material against the deflector plates of the hood and into pendulum hammers disposed in the upper portion of the hood above the elevation of the impact rotor. Crushed material is deposited in a windrow behind the rotor.

2 Claims, 2 Drawing Figures

MOBILE STONE CRUSHER

BACKGROUND OF THE INVENTION

A need exists in certain regions for a highly mobile crusher capable of reducing oversize iron ore, sandstone boulders and the like to an approximate 2½" gradation suitable for use as road base material. Frequently, old gravel pits contain oversize boulders which were rejected during earlier removal of pit-run material, and the logistics involved, and the quantities of the material available at each such location, renders conventional crusher operations impractical.

Consequently, the primary object of this invention is to provide an efficient portable rock crusher which can be easily and economically transported to the location of the rock rather than vice-versa, thereby eliminating most of the handling of the material as well as the conventional machinery involved.

A further object of the invention is to provide a mobile rock crusher whose structural configuration and mode of operation is more efficient and more practical than prior art devices for a broadly similar purpose.

Still another object is to provide a mobile rock crusher in the form of a compact essentially self-contained unit which can be installed in place of the usual bucket found on a track loader or similar equipment.

Another object of the invention is to provide a mobile rock crusher whose impact rotor assembly is powered by hydraulic motors on the crusher unit supplied by the hydraulic system of a track loader or the like.

Other features and advantages of the invention will become apparent to those skilled in the art during the course of the following detailed description.

DETAILED DESCRIPTION

Figure 1:
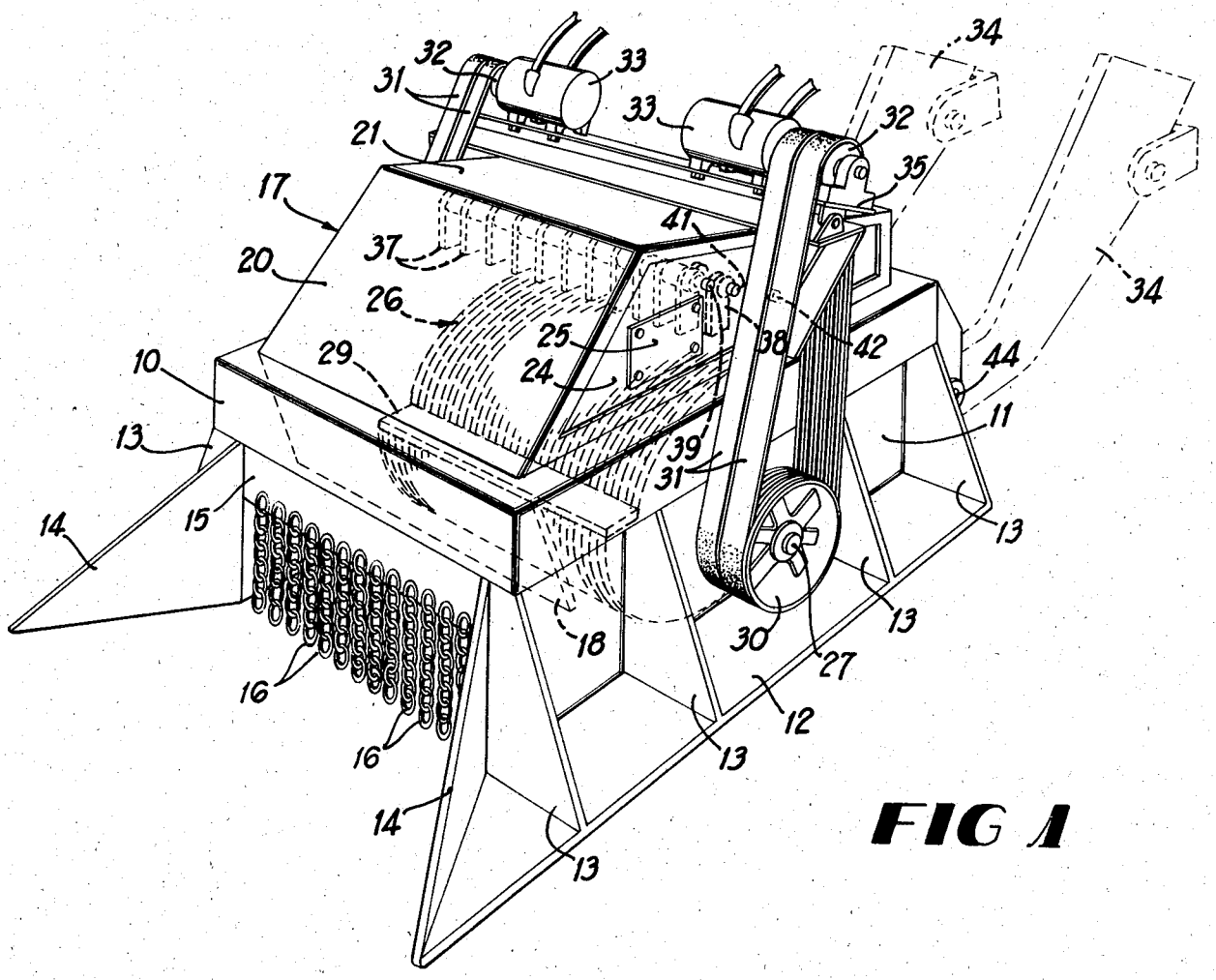
FIG. 1 is a perspective view of a mobile stone crusher according to the present invention.

Referring to the drawings in detail wherein like numerals designate like parts, a mobile stone crusher comprises a rigid horizontal rectangular frame 10 having welded thereto and extending therebelow a pair of spaced vertical side walls 11 defining a longitudinal passageway or "tunnel" extending through the crusher below its frame 10 from end-to-end thereof. Horizontal longitudinal skid plates 12 extend outwardly from the side walls 11 and are reinforced by bracing webs 13, as shown. The skid plates 12 extend for the full length of the machine on its opposite sides and somewhat forwardly of the frame 10 and the adjacent open end of the tunnel beneath the frame 10. A pair of forwardly divergent vertical plates 14 rise from the skid plates 12 at their forward ends and are integrally joined thereto and to the side walls 11 as by welding.

At the forward end of the frame 10, a short vertical panel 15 is welded to the frame and extends somewhat below it. A vertical curtain formed of link chains 16 serves as a closure for the forward end of the aforementioned passage or tunnel. The chain curtain diminishes scattering of stone particles undergoing disintegration through the forward end of the tunnel. The tops of the link chains are welded to the vertical panel 15.

The crusher further comprises a unitary hood 17 formed of steel plates which is welded to the interior of the frame 10 and is open at its bottom in communication with the passage or tunnel defined by the side walls 11 beneath the frame 10. The hood 17 is constructed of heavy steel plates. It comprises a forward inclined deflector plate 18 whose top edge is flush with the top of frame 10 and whose bottom edge 19 is at an elevation near the vertical center of height of the tunnel. The deflector plate 18 is flat and is steeply inclined from the horizontal with its top edge spaced forwardly of its bottom edge 19.

Figure 2:
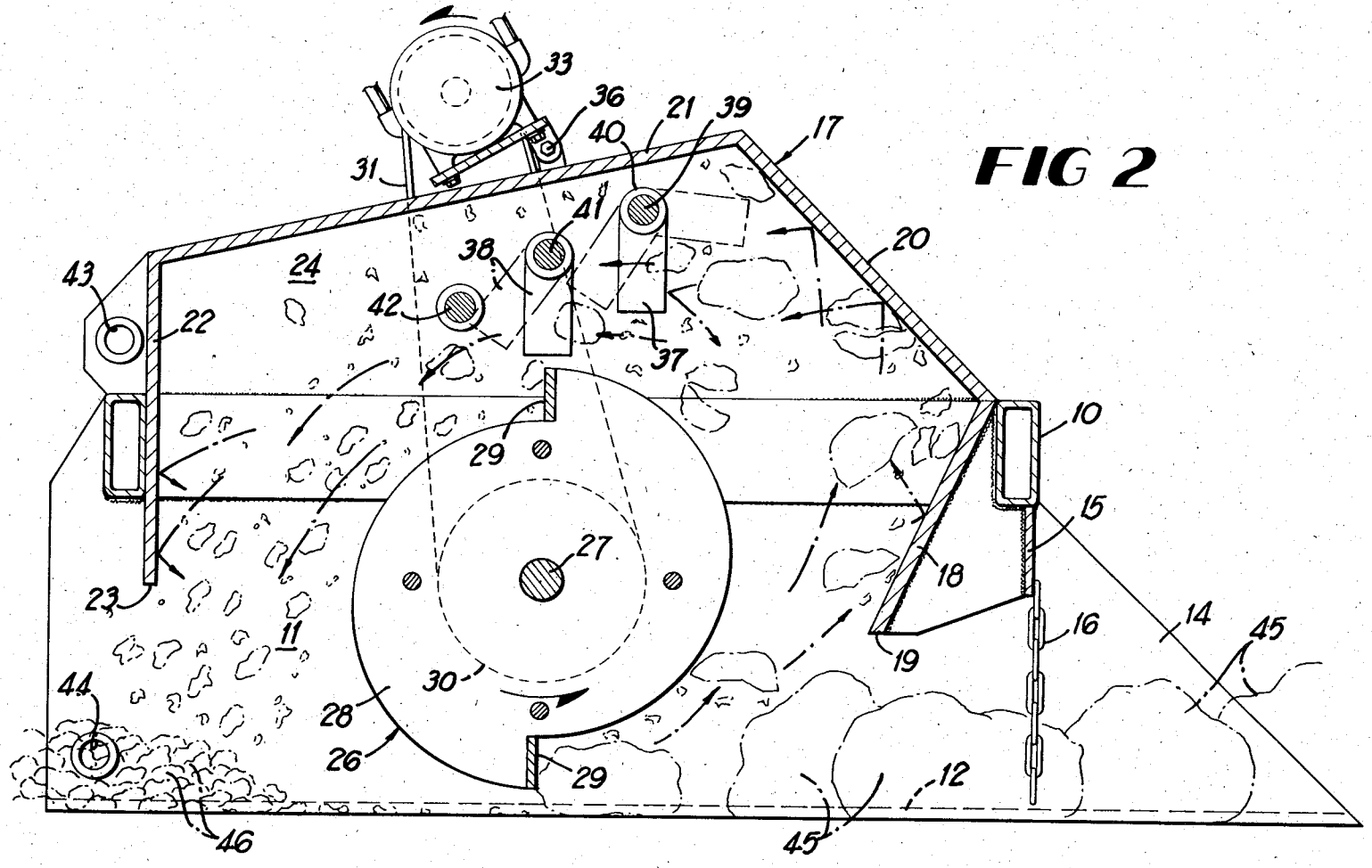
FIG. 2 is a longitudinal vertical section through the stone crusher.

Above the deflector plate 18, the hood 17 further comprises a flat rearwardly inclined plate 20 which is disposed at an angle to the horizontal of roughly 45°. At its top, the plate 20 is joined to a flat inclined roof plate 21 which slopes downwardly and rearwardly at a comparatively shallow angle to the horizontal and is joined at its rear by a vertical plate 22 whose lower edge 23 extends somewhat below the bottom of frame 10, as depicted in FIG. 2. The hood 17 is closed at its opposite sides by vertical side walls 24, at least one of which is equipped with a removable access plate 25, as shown in FIG. 1.

Within the body of the crusher defined by the hood 17 and side walls 11 is a horizontal transverse axis stone crushing rotor 26. The drive shaft 27 of this rotor is disposed substantially at the longitudinal center of the tunnel beneath the frame 10 and at an elevation somewhat below the frame, as shown in the drawings. The stone crushing rotor 26 is formed of a multiplicity of steel plates or segments 28 stacked on the drive shaft 27 and bolted together to form an offset decreasing radius rotor fitted with two diametrically opposing reversible and replaceable stone breaker bars 29. The outside edges of the bars 29 during rotation in the direction of the arrow shown in FIG. 2 pass somewhat above the top of the frame 10 and pass near ground level at the bottom of the machine, although spaced slightly thereabove.

The rotor drive shaft 27 is journaled in suitable bearings, not shown, on the side walls 11 and is powered in rotation by belt pulleys 30 near and outwardly of the side walls 11, these pulleys being driven by belts 31 close to the opposite sides of the machine. The belts 31 are engaged with additional pulleys 32 near and above the top of the hood 17, the pulleys 32 being powered by two 70 hp hydraulic motors 33 which are operated in unison through conventional controls from the hydraulic system of a track loader or the like having lift arms 34. The two hydraulic motors 33 are secured to a tilted adjustable mounting plate 35 arranged at the top of the hood wall 21. The drive belts 31 can be maintained under proper tension through adjustment of the mounting plate 35 which is pivotally attached to the hood wall 21 as at 36.

The two hydraulic motors 33 transmit 830 rpm through the pulleys 32 and belts 31 to the larger pulleys 30 on a preferably 4" diameter rotor drive shaft 27. This develops a high idle (no-load) rotor speed of approximately 425 rpm.

The stone crusher further comprises within the upper chamber of the hood 17 and above the rotor 26 two sets of pendulum stone breaking hammers 37 and 38. The set or gang of hammers 37 are pivotally mounted on an upper transverse horizontal hammer support rod 39 which spans the width of the hood 17 and has its ends supported on the two hood side walls 24. The steel hammers 37 and 38 are preferably about 8" long by about 4" wide and ¾" thick. They include hubs 40 on the rod 39 which maintain the pendulum hammers spaced apart a desirable distance, such as about 2½". This spacing of the pendulum hammers can be varied in the crusher to regulate the size of the aggregate being produced. The rod 39 for the hammers 37 is near and below the hood wall 21 and somewhat forwardly of the axis of rotation of the crushing rotor 26, as defined by its drive shaft 27.

The lower gang of pendulum hammers 38 are mounted on a rod 41 disposed rearwardly of and somewhat below the rod 39 and directly above the shaft 27 of the rotor. The rods 39 and 41 are parallel. A third stationary rod 42, rearwardly of and below the rod 41 and parallel thereto, serves as a limit stop for the rear and lower set of pendulum hammers 38. Similarly, the rod 41 forms a limit stop for the forward upper set of hammers 37. Like the rod 39, the two rods 41 and 42 have their ends supported on the hood side walls 24. The preferred clearance space between the tips of the hammers 28 and the breaker bars 29, when the latter are new and unworn, is about ½". As wear increases on the breaker bars 29, this clearance dimension will increase somewhat but is not allowed to exceed 1½".

At its rear end, the crusher is equipped with upper and lower attachment elements 43 and 44 for connection with the lift arms 34 and hitch components of the track loader employed to lift and carry the crusher.

OPERATION

The material to be crushed is first ripped and a wrecking ball is then used to reduce the size of boulders 45, FIG. 2, to less than 30". A road grader is then used to blade the material into a windrow. As the crusher machine is now advanced along the windrow of boulders 45 with the skid plates 12 substantially at ground level, the counter-rotating rotor 26 quickly develops a deposit of material in front of the rotor which then acts to propel the windrowed material upwardly and forwardly against deflector plate 18 which further disintegrates the material into smaller pieces. Some breaking of the rock occurs on initial impact by the breaker bars 29 and progressive breaking or disintegration occurs as the material ricochets between the rotor 26 and plates 18 and 20 and between these two plates themselves. Finally, the material comes into contact with the two sets of pendulum breaker hammers 37 and 38 which further acts on the material to reduce it to final aggregate size, such as 2½" suitable for use as a road base. After clearing the hammers 37 and 38, the crushed material 46 is deposited back in a windrow immediately behind the rotor 26, as shown in FIG. 2. If the material has not been reduced to the required gradation, a second pass of the crusher over the windrow is made. The finished product is then simply pushed into a stockpile in preparation for loading and transporting.

It can be seen that the crusher is simplified, very compact., self-contained, highly portable and efficient in its operation. The machine requires no set-up time at the work site and is ready for work as soon as it is unloaded from a haul vehicle.

Another feature of the machine is that the constant movement of the hammers 37 and 38 independently of one another prevents the accumulation of clay or other sticky material on or between the hammers, thus providing a self-cleaning action.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A mobile stone crusher comprising a track loader, a stone crusher mounted on said track loader including a hood having multiple angled stone deflector walls at its front, top and rear and being open at its bottom, spaced side walls connected with the hood and extending below the bottom of the hood and having skids along their bottom edges and defining between them a through passage adapted to receive windrowed stones during movement of the stone crusher along the windrow, a transverse horizontal axis impact rotor extending between and journaled on said side walls within the through passage near the longitudinal center of the through passage and the open bottom of the hood, power drive means for the impact rotor on the stone crusher driving it in rotation counter to the direction of movement of the stone crusher along a windrow of stones, and pendulum stone breaker hammer means held within the hood above the impact rotor whereby stones fractured by the rotor are deflected by said deflector walls of the hood into the pendulum hammer means and through such means, the stones which are then reduced in size falling in a windrow through the open bottom of the hood behind the impact rotor.

2. A mobile stone crusher comprising a vehicle, a stone crusher mounted on said vehicle including a hood having vertical side walls, a vertical rear wall, a forwardly upwardly inclined roof, a forwardly downwardly inclined deflector plate descending from the forward end of the roof and a lower downwardly rearwardly inclined deflector plate descending from the lower end of the first-named deflector plate and having a lower end terminating at an elevation somewhat below the lower end of said rear vertical wall of the hood, a frame carrying the hood at an above-ground elevation and having attached depending vertical side walls defining between them a longitudinal through passage for windrowed stone, the last-named side walls having skids on and along their bottom edges projecting horizontally outwardly therefrom and the last-named side walls having forward end divergent upstanding plates thereon tending to funnel windrowed stones into the through passage, a stone crushing transverse horizontal axis impact rotor journaled on the last-named side walls near the longitudinal center of the hood and through passage and extending within and across the through passage between the hood vertical rear wall and said lower deflector plate, said impact rotor having circumferentially spaced radial replaceable breaker bars fixed thereon adapted to engage and fracture windrowed stones in said through passage and propel them forwardly against said lower deflector plate, driving means for the impact rotor on said hood and causing the rotor to turn counter to the direction of movement of the mobile stone crusher along the windrowed stones, and plural horizontal transverse rows of pendulum stone breaker hammers supported within the hood on the vertical side walls of the hood above the impact rotor and beneath said roof of the hood and rearwardly of said forwardly downwardly inclined deflector plate, whereby windrowed stones being fractured by said rotor are deflected by said deflector plates toward and against said pendulum hammers which further reduce the size of the stones and allow the reduced stones to fall downwardly rearwardly of the rotor and onto the ground in a windrow behind the mobile stone crusher.

* * * * *